US005364296A

United States Patent [19]

Cerny

[11] Patent Number: 5,364,296

[45] Date of Patent: Nov. 15, 1994

[54] SIMULTANEOUS DOUBLE-BLADED KAYAK PADDLE

[76] Inventor: Harry R. Cerny, P.O. Box 1251, Dubois, Wis. 82513

[21] Appl. No.: 986,348

[22] Filed: Dec. 7, 1992

[51] Int. Cl.[5] ..... B63H 16/04

[52] U.S. Cl. ..... 440/101; 416/74

[58] Field of Search ..... 440/13, 14, 15, 21, 440/22, 23, 24, 25, 26, 101, 102, 103, 104, 105; 114/347; 416/69, 74

[56] References Cited

U.S. PATENT DOCUMENTS

| | | | |
|---|---|---|---|
| 892,418 | 7/1908 | Hauman | 440/25 |
| 2,873,713 | 2/1959 | Baastrup | 440/21 |
| 3,297,283 | 1/1967 | Knaver | 440/26 |
| 3,677,216 | 7/1972 | Gentemann | 440/102 |
| 3,800,734 | 4/1974 | Whang | 440/101 |
| 4,820,216 | 4/1989 | Masters | 440/101 |
| 5,062,816 | 11/1991 | Berglund | 440/101 |
| 5,114,371 | 5/1992 | Alonzo | 440/101 |

FOREIGN PATENT DOCUMENTS

| | | | |
|---|---|---|---|
| 596333 | 4/1960 | Canada | 440/101 |
| 3628637 | 3/1988 | Germany | 440/101 |

*Primary Examiner*—Stephen P. Avila
*Attorney, Agent, or Firm*—Ralph S. Branscomb

[57] ABSTRACT

A paddle for a narrow canoe or kayak-type boat has a crossbar the end portions of which extend downwardly to create an inverted U-shape, with the blades being at the lower ends of U. Handgrips, preferably including either forearm rests or wrist rests for the tops of the forearms or wrists as well as handgrips, enable the user to operate the paddle in a broad sweeping motion, with both blades being inserted into the water and pulled back simultaneously, eliminating the yaw effect of either double-ended kayak paddles or single-bladed canoe paddles.

18 Claims, 1 Drawing Sheet

SIMULTANEOUS DOUBLE-BLADED KAYAK PADDLE

BACKGROUND OF THE INVENTION

The subject matter of this application was filed under the Disclosure Document Program of the Patent Office on Aug. 19, 1992, and received Disclosure Document Number 315,761.

Canoes and kayak-type boats provide the most efficient means for one or two people to propel themselves through the water without the use of a motor. The narrow hull not only reduces water resistance, but enables the operator to conveniently access the water on both sides of the boat. This is more important in a kayak, in which the beam of the boat must be narrow enough that the paddler can paddle on both sides of the boat without moving from his seated position.

Kayaks and canoes are much more agile than rowboats. Paddling provides an obvious maneuverability and agility advantage over rowing as a means of propelling a small boat, even if they are the same hull shape.

The big disadvantage of paddling over rowing is the inevitable yaw effect produced every time the paddle is stroked. Since the paddle only strokes one side of the boat at a time, it tends to yaw in the opposite direction.

Two-passenger canoes reduce this effect somewhat by the use of simultaneous paddling on opposite sides of the boat by the two canoers. Nonetheless, since the paddlers are spaced apart, the yaw effect still exists, and coordination of the two canoers is difficult unless they are experienced working as a team.

The extent of the problem with kayaks depends on the type of kayak. Typically, a kayak is a single-passenger vessel, so that the dual paddling possible in canoes cannot be done. However there are some sea kayaks which are dual passenger. Paddlers in a sea kayak, unlike canoe paddlers, must paddle in a synchronized fashion because they are seated so close together. Thus, the problem is not simplified, although sea kayaks have a keel and usually a rudder which helps them maintain course.

More traditional kayaks and river-running kayaks have no keel at all, and have almost no directional preference. It is very difficult even for an experienced paddler to paddle a very short, state-of-the-art river runner in a straight line. These boats are designed specifically to make quick turns when going downstream to avoid rocks. When paddling these boats on a lake or other open stretch of water, many of them will refuse to go straight, and cause the paddler to spend 20 or 30% of his paddling energy keeping the boat straight rather than moving it forward.

There is a need, therefore, for a new type of kayak-type boat paddle and a technique for using it which preservers the maneuverability characteristics of paddle craft but eliminates or reduces the drawback of propelling the boat from one side or the other during any one paddle stroke.

SUMMARY OF THE INVENTION

The paddle disclosed herein fulfills the above-stated need and comprises a generally U-shaped crossbar with a generally straight central portion with downwardly extended end portions which mount the paddle blades. The central portion of the crossbar is fitted with gripping means which include a handgrip for each hand, and preferably either a forearm brace or a wrist brace associated with each handgrip.

The paddle has several optional adjustments to accommodate different paddlers and boats and paddling styles, including crossbar span-width adjustment, lateral positional adjustment of the handgrips on the crossbar, and both vertical and horizontal adjustability of the blades on the crossbar end portions.

Aside from these features, the paddle can be provided with either (or both) horizontally extended handgrips engaged directly around the central portion of the crossbar, or orthogonally extending handgrips. With the orthogonally extended embodiment, a grip sleeve is pivotal around a central post of the handgrip for both the left and right handgrips. The pivotal handgrips accomodate the variations of arm angle with respect to the crossbar which occur during the paddling cycle.

DETAILED DESCRIPTION OF THE PREFERRED EMBODIMENT

Figures 1, 2, 3, 4, 5, 6, 7:
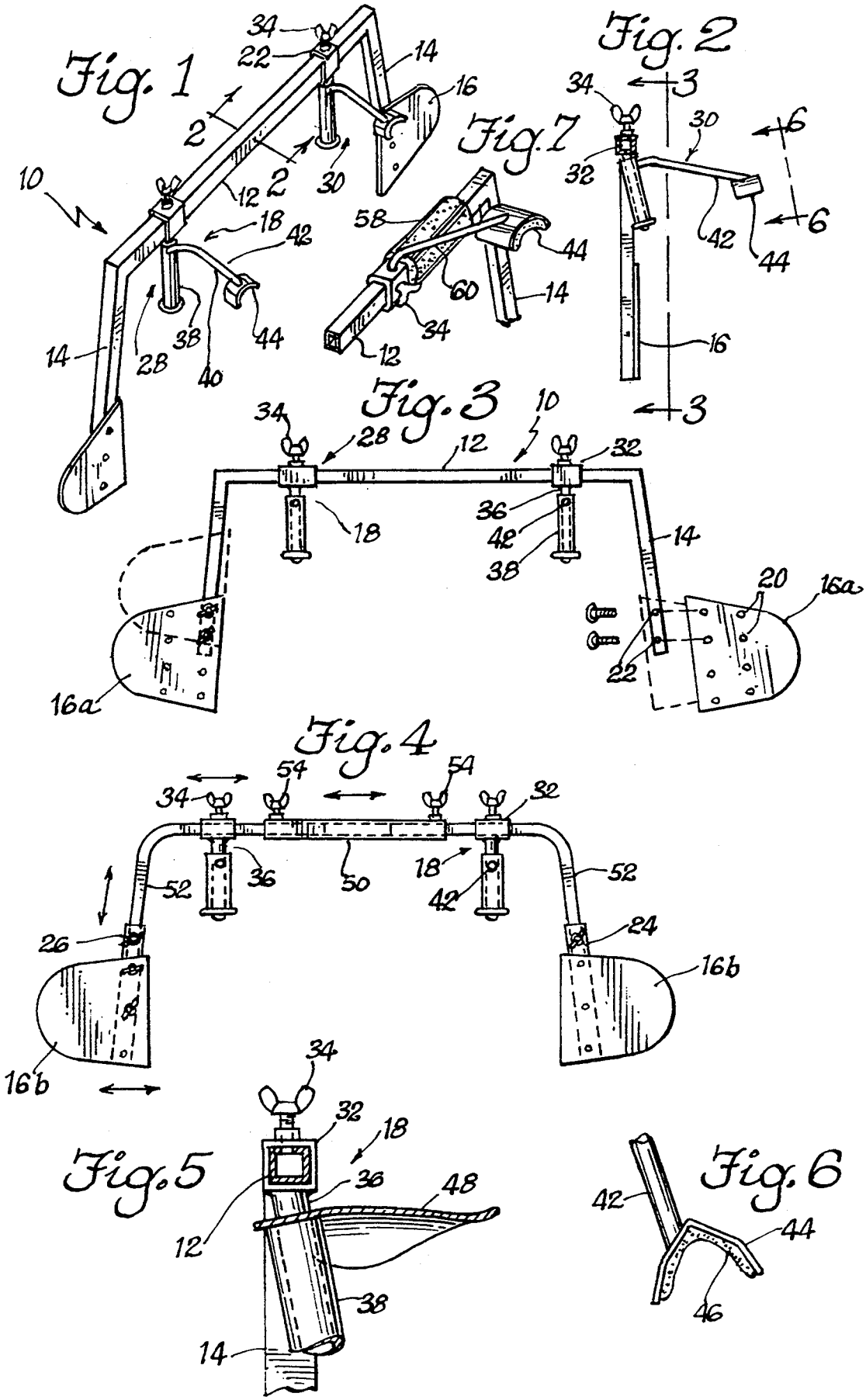
FIG. 1 is a perspective view of one form of the paddle.
FIG. 2 is a section taken along line 2—2 of FIG. 1.
FIG. 3 is a section taken along line 3—3 of FIG. 2.
FIG. 4 is a front elevation view of a modified form of the invention having crossbar span-width adjustability and a modified paddle blade mount, with the forearm braces in section.
FIG. 5 is another modification of the invention using a wrist brace rather than a forearm brace, as seen in fore-to-aft section through the wrist brace.
FIG. 6 is a view from the front of the paddler as seen along line 6—6 of FIG. 2; and, FIG. 7 illustrates a modification of the positioning of the handgrip wherein it is horizontal, directly around the crossbar.

Within the overall concept of the invention, there are a number or details of construction which may be modified. One of the principle modifiable features is the exact configuration of the crossbar 10. This crossbar, as shown in FIG. 1, is angled sharply between the central transverse portion 12 and the downwardly extending end portions 14 which mount the paddle blades 16. A slightly different overall crossbar shape is illustrated in FIG. 4, wherein the end and central portions of the crossbar are curved, rather than being angulated. In the illustrated embodiments, all forms of the crossbar are shown as being of box-beam construction, so that the gripping means 18 are easily transversely adjustable while being non-rotational relative to the cross beam.

The same design flexibility characterizes the blades 16. The blades are shown in FIGS. 1 and 2 as being fixed to the end portions of the crossbar with screws, rivets or the like, whereas in FIG. 3 the modified blade 16*a* has four hole pairs 20, permitting two different vertical and two different horizontal mounting position options. These holes are of course alignable with a pair of holes 22, through which the blade mounting bolts pass.

Another possible blade construction is shown in FIG. 4 at 16*b*. According to this construction, a square sleeve 24 is mounted to each blade, with the sleeve being received on the respective end portion of the crossbar and held in place with any suitable detent such as set screw 26. Clearly, these three different paddle blade embodiments are exemplary only, and many other fixed or adjustable variations are possible.

Although it would be possible to use the paddle as described above, that is, without any gripping means, it likely would not be practical. In order to deliver powerful paddle strokes to the blades, a secure means of interfacing and leveraging between the paddle and the paddler is required. The first of these, illustrated in FIG. 1, is the preferred embodiment. A left and right combination forearm brace/handgrip 28 and 30 each has a mounting sleeve 32 which transversely slides on the central portion of the crossbar and a wingnut-type set screw 34. This sliding adjustability accommodates the same paddle to differently dimensioned paddlers and boats, and different paddling styles and preferences. It would be possible to merely rigidly mount the forearm brace/handgrip units to the central portion of the crossbar without incorporating an adjustability feature.

Each of the mounting sleeves 32 has a rigid post 36 mounted to it which extends orthogonally to the crossbar orientation. In the illustrated embodiment, these posts extend substantially vertically downwardly, with a slight aft rake as shown in FIG. 5. With suitable modifications to the other structure, this handgrip could be forwardly directed or extended at some other angle than that shown. Each post has a grip sleeve 38 which could be cylindrical as shown in the drawings or could conform to the anatomy of the hand. Each grip sleeve is strong and rigid, and is rotational around the post to which it is mounted.

In the first described embodiment, a forearm brace 40 for each of the handgrips is mounted to the grip sleeve, and forms part of the gripping means. Some type of support of this nature is almost essential, as when the paddler draws back during the paddling stroke, considerable torque pulling the blades forward away from the paddler will be experienced. Without the forearm braces, the paddler would have to counter these forces with his wrists alone. This would become very tiring very soon.

The forearm braces are comprised of an elongated stem 42 with a forearm-engaging cup 44 which may be covered with padding 46, as shown in FIG. 6. The stems and cups require considerable strength and would ordinarily be made of metal, as would the grip sleeves 38.

As an alternative to the forearm braces, wrist braces 48 as shown in FIG. 5 could be used. These are simply curved, rearwardly-extended plates that rest on the top of the wrists. The wrist braces could actually be used in conjunction with the forearm braces, or a hybrid which is supported along the entire frontal portion of the forearms and wrists could be used. The wrist embodiment is somewhat more compact and lightweight than the forearm brace, but would not provide the leverage or support that the latter does.

Two of other modifications need mentioning. First, as shown in FIG. 4, the crossbar is being made span-width extensible by the use of telescoping members. The left half could telescope into the right half, for example, or as shown in FIG. 4 a central outer tube 50 could span a portion of the central portion of the crossbar, with the remaining crossbar structure comprising left and right sides 52 which are fixed in the outer tubes with wingnut set screws 26. Width adjustability of the crossbar eliminates the need to provide it in different sizes.

FIG. 7 illustrates a modification in which the handgrips 58 are horizontal, being mounted directly on the central portion of the crossbar. It is non-rotational around the crossbar of course, and the forearm brace 60 that is used with this modification must be elevated to the extent that the forearm is elevated in this position.

FIGS. 1 through 6 have in large part been based on a prototype unit. This unit, though being functional and practical, and light enough to use for several hours without tiring, is somewhat rough compared to a production unit. For this reason, the parts may appear to be heavy. In production, in all likelihood metal portions of the paddler would be made of lightweight aluminum. Elongated members could be lightweight metal, or composite. The wingnut set screws of the gripping means and certain other features are of an exaggerated size so that they show up clearly in the drawings. Because even the prototype is light enough to be operable for several hours without tiring, there is no doubt that a production unit could be made very light indeed, especially if some or all of the adjustability features were eliminated in the name of streamlining the unit.

The inventor was inspired to create the paddle while paddling a canoe. Any boat having a narrow beam such as a canoe or kayak, which is paddled on alternate sides by the operator, should be usable in conjunction with this paddle. Beam and draft variations from boat-to-boat are accommodated by the various adjustability features of the disclosed paddle, and of course could likewise be accommodated by different models of a non-adjustable or partially adjustable unit.

It is hereby claimed:

1. A watercraft paddle comprising:

(a) an arched, generally U-shaped crossbar having a central transverse portion and downwardly extending left and right end portions;

(b) a paddle blade defined on each of said end portions and being substantially immobile relative to said crossbar;

(c) gripping means defined on said crossbar comprising:

(i) a left and right handgrip region defined generally centrally of said crossbar enabling a paddler to grip said paddle with both hands;

(ii) left and right forearm braces mounted on said crossbar, said forearm braces corresponding to said left and right handgrip region and being rigid and non-rotationally mounted relative to said crossbar, and configured to brace against the tops of the forearms as the paddler grips said handgrip region;

(d) said paddle being integrally constructed and of light-weight compact design capable of being operated by a single paddler as a complete self-contained unit independent of all structure including support structure of a watercraft with which it is used, such that the user can grip said gripping means, insert both paddle blades into the water on both sides of a watercraft at substantially the same time, and with said forearm braces resting against the forearms, repeatedly raise said paddle substantially completely clear of the water and then forcibly lower said paddle driving said blades downwardly and rearwardly into and through the water in a paddling motion to deliver a power stroke to both of said blades substantially simultaneously, propelling the watercraft forwardly by reacting off the water on both left and right sides of the watercraft substantially simultaneously, such that a paddling-type action is achieved but the yaw-inducing moments inherent in traditional paddling strokes are substantially mutually cancelling.

2. A paddle according to claim 1 wherein said crossbar is span-width adjustable to provide a range of different crossbar span widths.

3. A paddle according to claim 2 wherein the central transverse portion of said crossbar includes telescoping members and means to fix said telescoping members at one of a plurality of selectable span width settings.

4. A paddle according to claim 1 and including blade adjustment means whereby said paddle blades are each positionally adjustable both laterally and vertically on the end portions of said crossbar.

5. A paddle according to claim 4 wherein said blades have mounting sleeves slidingly engaged on the crossbar end portions and including detent means to set said blades at selected positions along said end portions such that said blades are vertically adjustable thereon.

6. A paddle according to claim 1 wherein said handgrips are mounted on the central portion of said crossbar and are laterally slidably adjustable thereon.

7. A paddle according to claim 1 wherein said handgrip area include a left and right handgrip mounted on said crossbar and said handgrips are mounted directly around said crossbar such that the operator engages substantially horizontal portions of the crossbar directly with the hands.

8. A paddle according to claim 1 wherein said handgrip area includes a left and right handgrip mounted on said crossbar and said hangrips are mounted on said crossbar in substantially radially extended relation thereto.

9. A paddle according to claim 8 wherein said handgrips each comprise a rigid post mounted to said crossbar and a rotatable grip sleeve mounted on each of said posts.

10. A paddle according to claim 9 wherein said posits are slidably engageably mounted on said crossbar.

11. A paddle according to claim 1 wherein said forearm braces are slidably adjustable on said crossbar.

12. A paddle according to claim 11 wherein said left forearm brace and left handgrip, and right forearm brace and right handgrip, are respectively integral to define left and right forearm/handgrip units, together comprising said gripping means.

13. A paddle according to claim 12 wherein said left and right forearm/handgrip units are each independently laterally slidably adjustable on said crossbar.

14. A paddle according to claim 12 wherein said left and right handgrips each comprise a post substantially orthogonally extended from said crossbar and a rotational grip sleeve engaged on the post, with said forearm braces being integral with said grip sleeves and rotational around said posts.

15. A paddle according to claim 1 wherein said gripping means includes left and right wrist braces corresponding to said left and right handgrips and being non-rotationally mounted on said crossbar.

16. A paddle according to claim 15 wherein said wrist braces are non-rotatably slidably adjustably mounted to said crossbar.

17. A paddle according to claim 16 wherein said left wrist brace and left handgrip, and right wrist brace and right handgrip, define respective integral left and right brace/handgrip units.

18. A paddle according to claim 17 wherein said handgrips each comprises a post orthogonally extended from said crossbar with a rotatable sleeve engaged on the post, and said wrist braces are integral with the respective sleeves and rotate therewith around the respective posts.

* * * * *